United States Patent [19]

Straubel et al.

[11] Patent Number: 4,459,964

[45] Date of Patent: Jul. 17, 1984

[54] FUEL SUPPLY APPARATUS FOR INTERNAL COMBUSTION ENGINES

[75] Inventors: Max Straubel; Gerhard Stumpp, both of Stuttgart, Fed. Rep. of Germany

[73] Assignee: Robert Bosch GmbH, Stuttgart, Fed. Rep. of Germany

[21] Appl. No.: 388,329

[22] Filed: Jun. 14, 1982

[30] Foreign Application Priority Data

Jul. 11, 1981 [DE] Fed. Rep. of Germany ..... 3127543

[51] Int. Cl.[3] ..... F02M 25/06

[52] U.S. Cl. ..... 123/569; 123/568; 123/514

[58] Field of Search ..... 123/514, 516, 569, 568

[56] References Cited

U.S. PATENT DOCUMENTS

| | | | |
|---|---|---|---|
| 4,286,507 | 9/1981 | Ueda | 123/569 |
| 4,346,687 | 8/1982 | Bauder | 123/516 |
| 4,373,496 | 2/1983 | Greiner et al. | 123/569 |

FOREIGN PATENT DOCUMENTS

| | | | |
|---|---|---|---|
| 2658052 | 7/1978 | Fed. Rep. of Germany | 123/569 |
| 47617 | 4/1981 | Japan | 123/569 |
| 137644 | 8/1982 | Japan | 123/569 |
| 2031997 | 4/1980 | United Kingdom | 123/568 |
| 787711 | 12/1980 | U.S.S.R. | 123/569 |

*Primary Examiner*—Wendell E. Burns
*Attorney, Agent, or Firm*—Edwin E. Greigg

[57] ABSTRACT

A fuel supply apparatus for internal combustion engines having a fuel injection pump for supplying a regulatable fuel injection quantity, a ventilation apparatus of the fuel injection pump, a fuel quantity meter and exhaust gas recirculation in accordance with fuel quantity. In the ventilation or overflow line for the pump interior pressure, there is a ventilation valve which responds at least when the pump interior pressure has attained a pressure value which results at an engine rpm outside the exhaust gas test range. In this case, the overflow line of the fuel injection pump is connected with the fuel supply container. At a lower rpm which is within the exhaust gas test range, the ventilation valve may be switched such that a connection is established with the pump inflow downstream of the fuel quantity meter. The ventilation valve may also be embodied as a magnetic valve which is actuated by pressure switches exposed to the pump interior pressure.

8 Claims, 4 Drawing Figures

FUEL SUPPLY APPARATUS FOR INTERNAL COMBUSTION ENGINES

BACKGROUND OF THE INVENTION

The invention is based on a fuel supply apparatus for internal combustion engines having a fuel injection pump for supplying a regulatable fuel injection quantity, a ventilation valve apparatus for said fuel injection pump and exhaust gas recirculation means controlled in accordance with fuel quantity. In such fuel injection pumps, it is known to perform a cooling of the distributor pump and thus of the fuel pumped by it and delivered to the injection valves. This is particularly important when the fuel injection quantity is regulated by means of volumetric metering and a maximum of power is to be maintained without exceeding the maximum permissible limits for toxic exhaust gases. In this respect, a heat exchanger is also conceivable, where temperature probes are provided which deliver the fuel used for cooling to the cooler of the distributor injection pump via associated fuel lines. Such types of fuel supply apparatus additionally operate with a generally mechanically regulated exhaust gas recirculation system, in which with respect to the engine rpm there is a definite exhaust gas test range, within which the exhaust gas recirculation is effective, frequently being controlled in quantity, while at very high engine rpm outside the test range, it is desirable to provide a shutoff of the exhaust gas recirculation. This is frequently accomplished by means of a suitable control of exhaust gas recirculation effected with respect to the fuel quantity supplied by the fuel injection pump. The disposition of a cooler and the associated lines for the distributor pump is complicated and is expensive in terms of both engineering effort and cost.

OBJECT AND SUMMARY OF THE INVENTION

The fuel injection apparatus according to the invention has the advantage over the prior art that the fuel temperature can be regulated to a substantially constant value in a particularly simple manner, and it is no longer necessary to provide a cooler and the associated lines. Effective cooling of the pump is attained, especially in the critical range—that is, at high rpm—and the overflow quantity is delivered directly back to the fuel supply container. Thus, whenever predetermined operational ranges arise, or in other words from time to time, the fuel injection pump is always ventilated cleanly.

A further advantage is that in the rpm range above the maximum rpm occurring within the exhaust gas test range, the recirculated exhaust gas quantity is reduced, because of the fuel which is merely flushed through the distributor injection pump but not consumed by it. Thus, the engine is soiled to a lesser degree, and in the lower rpm range, a stabilization of the fuel temperature takes place.

By means of the characteristics delineated hereinafter, advantageous further embodiments of and improvements of the fuel supply apparatus are possible. It is also particularly advantageous that during overrunning, above a lower idling rpm, the ventilation line can likewise be carried directly back into the fuel tank. In addition, it is possible to trigger magnetic valves by means of specialized pressure switches having an electrical output variable, and in so doing it is also possible, during starting and while the engine is operating but is still cold, to take into consideration corresponding positions of the arbitrarily actuated driving pedal as well as operational states of the starter and of a thermal switch which may be provided if needed.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
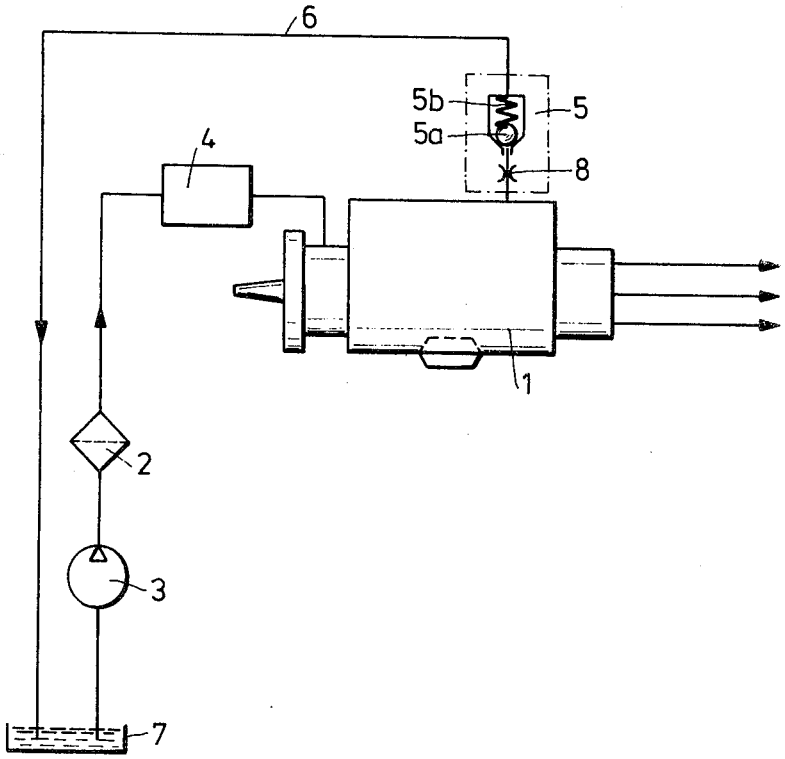
FIG. 1 shows a first exemplary embodiment of a ventilation of a fuel injection pump effected in accordance with operational states.
Figure 4:
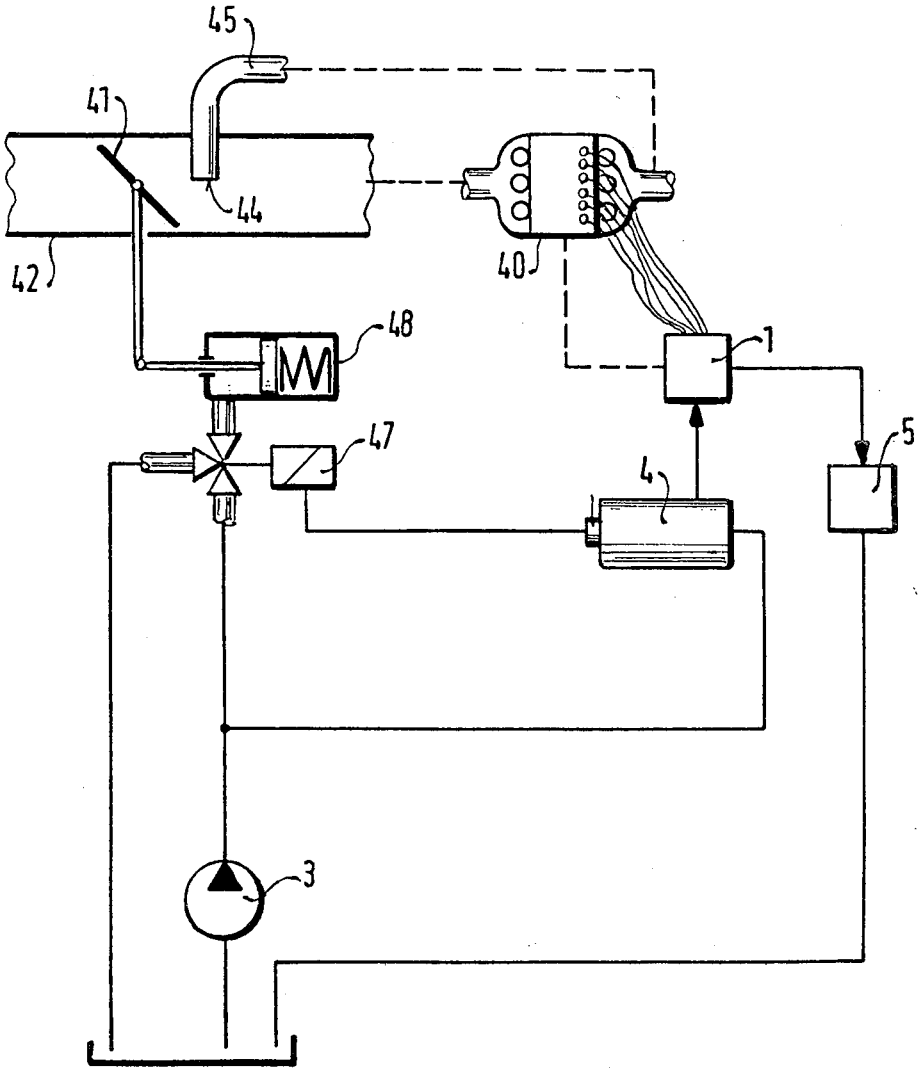
FIG. 4 shows schematically the relationship of the ventilation apparatus for the fuel injection pump to an exhaust gas recirculation means controlled by a regulatable fuel injection quantity.

Turning now to the simple first exemplary embodiment of the invention shown in FIG. 1 and to the system diagram of FIG. 4, the fuel injection pump is identified as 1; in order to supply fuel to an internal combustion engine 40, schematically shown, the pump is supplied with fuel via a filter 2 and a fuel supply pump 3, which may also be a pre-supply pump or may even be omitted entirely, if a fuel supply pump is integrated with the fuel injection pump itself. The fuel injection pump may be a series injection pump of known type, and in a known manner the fuel to be supplied to the engine is withdrawn from the suction chamber of the injection pump during the intake stroke of the injection pump pistons. The fuel quantity not required during the injection stroke of the pump pistons, for instance in the partial-load range, is returned to the suction chamber, and particularly the fuel located in the suction chamber is warmed up thereby. Between the filter 2 and the pump inflow, a fuel quantity meter 4 is generally provided as well, being part of the mixture regulator; however, no further discussion of this element is necessary here. The mixture regulator determines the mixture composition, based on the fuel supplied by or delivered to the fuel injection pump 1, and it is capable of opening a throttle valve 41 in the intake tube 42 in accordance with the fuel quantity and thereby also closing the inlet opening 44 of an exhaust recirculation line 45 into the intake tube, this closure being effected simultaneously if needed.

Figure 1A:
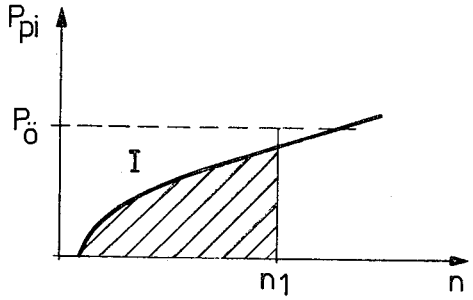
FIG. 1*a* shows the dependency of the interior pump pressure on the engine rpm.

The diagram of FIG. 1*a* shows in qualitative form the dependency of the pressure $p_{pi}$ in the pump interior over the engine rpm n. The shaded zone up to rpm $n_1$, below the curve course I, represents the exhaust gas test range or the CVS test range as well. In the diagram of FIG. 1*a*, the symbol $p_{\ddot{o}}$ represents the opening pressure of a mechanical ventilation actuation switch 5, which is embodied as a valve and disposed in the overflow of the injection pump; from it, a ventilation line 6 leads to the fuel supply container 7. The ventilation actuation switch 5 is preferably embodied as a simple check valve and includes a ball 5*a* as its valve member, which is pressed at a predetermined pressure against a seat by a spring 5*b*; an overflow throttle 8 may also be disposed in the inlet to the ball pressure valve. The opening pressure $p_{\ddot{o}}$ of the ventilation valve thus embodied—although it may also be pressure regulator of any arbitrary embodiment—is in any case adjusted such that it is above the pump interior pressure $p_{pi}$ developed in the exhaust gas test at the highest rpm $n_1$. Therefore, if the engine supplied with fuel by the fuel injection pump 1 is operated at an rpm, for instance in the full-load range, at which the ventilation valve opening pressure $p_{\ddot{o}}$ is equal to or smaller than the pump interior pressure then prevailing at this rpm, then the ventilation valve opens; effective cooling of the pump then takes place in the critical range, since the pump is supplied additionally with cool fuel from the fuel supply container 7, which is used as a heat exchanger; the quantity of this fuel is such as reaches the fuel supply tank 7 by way of the ventilation valve.

At the same time, a mechanism is attained in this connection, in combination with the regulated recirculation of exhaust gas, which causes the mixture regulator to reduce or entirely suppress the recirculated exhaust gas quantity. In fact, the fuel quantity meter 4 in the pump inlet now measures a larger fuel quantity than is effectively used by the engine, so that a larger fresh-air component is now established by the mixture regulator as well, by reducing or blocking off the recirculated exhaust gas quantity. This is effected overall within an rpm range above the maximum rpm in the exhaust gas test, because of the adjustment of the opening pressure of the ventilation valve 5 as already discussed. It will, furthermore, be understood that the ventilation valve 5 must be embodied such that in the exhaust gas test range, that is, below the rpm $n_1$ of FIG. 1 it is substantially tight, in order to avoid the possible establishment of an incorrect air/fuel ratio.

The fuel quantity determined by the fuel quantity meter 4, which corresponds to the fuel quantity delivered to the injection pump 1, then serves as a standardizing signal for the exhaust gas recirculation system, and in a manner which is at first arbitrary it influences the exhaust gas quantity once again returned to the intake tube at a particular time or else suppresses the recirculation of the exhaust gas entirely.

In order to adjust the recirculated exhaust gas quantity, the output signal of the fuel quantity meter 4 can then be delivered to a magnetic valve 47, for example, which proportionately subjects a hydraulic control motor 48 to the system pressure in such a manner that a throttle valve 41 disposed in the intake tube 42, for example, is pivoted such that upon relatively extensive opening of the throttle valve in order to increase the supply of fresh air, a simultaneous covering over of the mouth of an exhaust gas recirculation line into the intake tube is effected, this being proportional to the measured fuel quantity.

However, it is also possible to use any desired manner of control motor for driving a mechanical baffle, for example, in the exhaust gas recirculation line, the motor using the output signal, which is proportional to the fuel quantity, of the fuel quantity meter and effecting a corresponding baffle position relating to the quantity of fuel supplied to the distributor injection pump. Instead of a mechanical baffle of this kind in the exhaust gas recirculation line, it is also possible to have a magnetic valve or some means which successively close off the mouth of the exhaust gas recirculation line into the intake tube.

Figure 2:
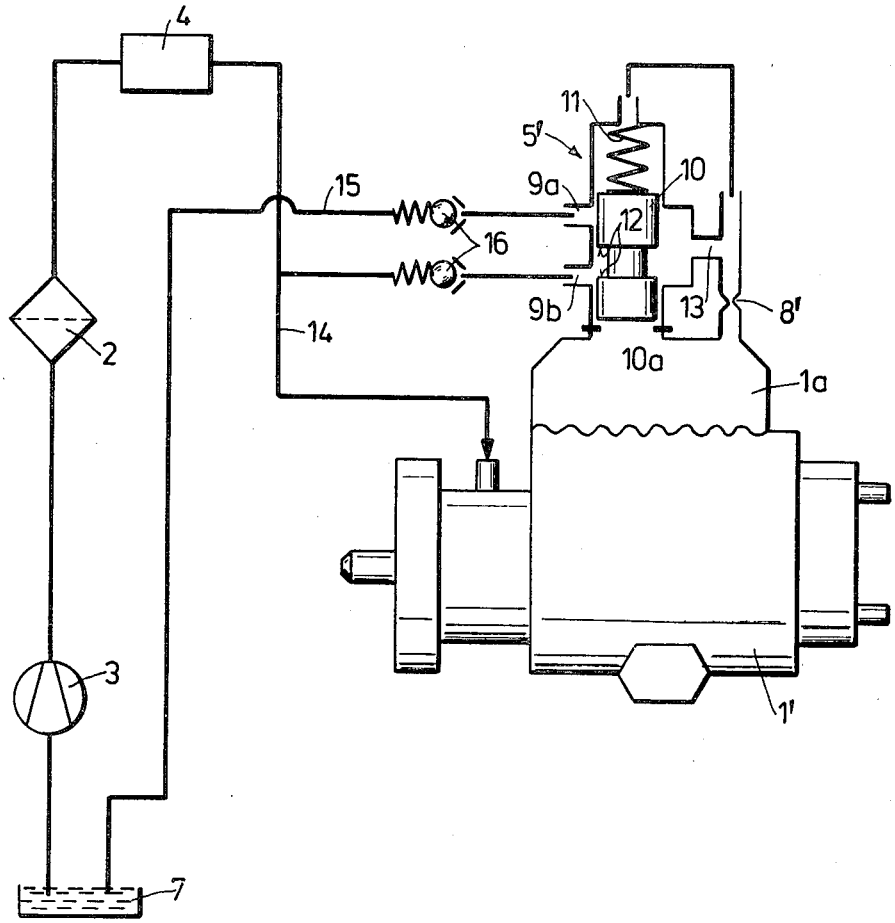
FIG. 2 shows a second exemplary embodiment of the ventilation of a fuel injection pump, illustrated schematically with two different ventilation positions.

In the exemplary embodiment of FIG. 2, the ventilation valve 5' is embodied as a valve which is again controlled by the interior injection pump pressure $p_{pi}$, but it has two outlets 9*a* and 9*b*, and the pressure control is effected in two stages. The ventilation valve 5' of FIG. 2 has a valve member in the form of a spring-loaded piston 10; the prestressing spring 11 is embodied as a compression spring. In accordance with the pump interior pressure already shown in FIG. 1*a*, the spring-loaded piston is controlled on its piston face 10*a* in accordance with rpm from the interior 1*a* of the fuel injection pump 1' in such a manner that at low rpm and thus low pump interior pressure, control edges 12 of the piston 10 switch the discharge line 13 to the pump inlet 14, while at high rpm the outlet 9*b* of the ventilation valve 5' is blocked, and the outlet 9*a* is opened, which connects the discharge line via a connecting line 15 with the fuel supply container 7. Check valves 16 may be disposed in both discharge lines of the ventilation valve 5'. The ventilation valve 5' in the exemplary embodiment of FIG. 2 is again designed and adjusted such that the discharge quantity of the fuel injection pump, within the exhaust gas test range, is again returned directly to the pump downstream of the fuel quantity meter 4. Outside the test range, at a correspondingly high rpm, the discharge quantity reaches the tank, as a result of which not only clean ventilation of the pump but also effective cooling are attained, at operational states which may possibly be thermally critical. The control of the exhaust gas recirculation system may be effected via the fuel quantity meter in the same manner as has already been explained in connection with FIG. 1. Here again, the fuel quantity meter always measures the total fuel quantity delivered to the pump inlet, which within the exhaust gas test range also equals the quantity delivered to the injection valves, while outside the test range the discharge quantity (return-flow quantity) is added to it.

Figure 3:
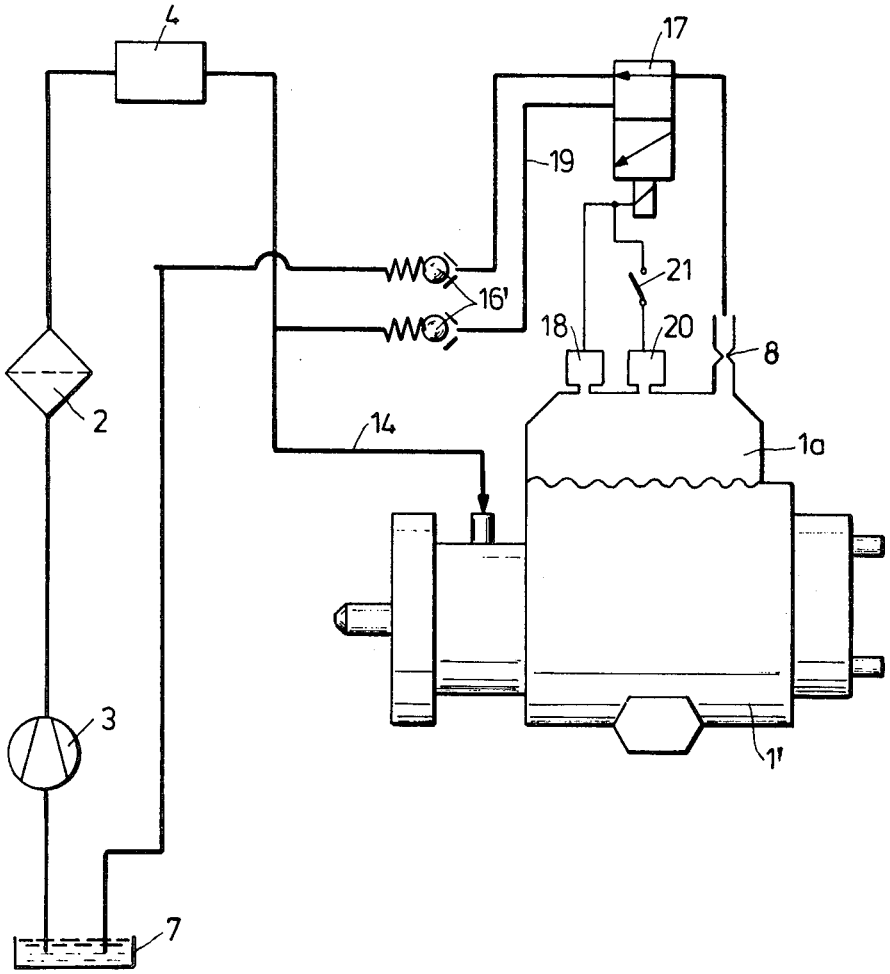
FIG. 3 shows a variant of the illustration provided in FIG. 2, having pressure switches controlled from the pump interior and having electrical output variables.

In the exemplary embodiment of FIG. 3, the mechanical ventilation valve has been replaced by a magnetic valve 17, which permits the ascertainment of peripheral conditions as well. In a simplified embodiment, the magnetic valve may be embodied soley as a switching on or an actuation valve and then functions like the ventilation valve 5 of FIG. 1; the actuation of the magnetic valve 17 is effected via a pressure switch 18, which is actuated in turn by the pump interior pressure. Above a predetermined pump interior pressure, or in other words, above the rpm limit resulting from the exhaust gas test range, for example, the magnetic valve then switches on the ventilation circuit, with recirculation of the discharge quantity being effected directly into the fuel supply container 7.

In accordance with a preferred embodiment, however, the magnetic valve is embodied as a reversible magnetic valve, so that below the rpm threshold the discharge quantity downstream of the fuel quantity meter 4 is again returned to the pump inlet via and connecting line 18, while above the rpm threshold and with effective cooling having been switched on, circulation is established via the fuel supply container 7 upon the response of the pressure switch 18.

In a further embodiment, it is also possible for two pressure switches actuated by the pump interior pressure to be provided, the second pressure switch being identified by reference numeral 20. This latter switch can respond at a substantially lower rpm threshold and open the discharge line to the fuel supply container 7. In this case, however, the switch 20 is connected in series with a switch 21 actuated from the driving pedal and then serves additionally to effect ventilation via the fuel supply container 7 during overrunning above idling rpm. Since the magnetic valve 17 can be switched on electrically, it is also possible to switch it on, for example, when the starter switch is actuated, and possibly also by means of a thermal switch (not shown) upon starting and while the engine is still cold, so that in these operational states as well, a switchover can be made to ventilation via the fuel supply container 7.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of The United States is:

1. In a fuel supply apparatus for internal combustion engines:

a fuel injection pump for supplying a regulatable fuel injection quantity drawn out of a suction chamber of said pump, said chamber having inlet and outlet conduits and being supplied with fuel under rpm dependent pressure;

an exhaust gas recirculation means controlled in accordance with fuel quantity;

and an overflow valve in said suction chamber discharge conduit, said overflow valve being controlled by the rpm dependent pressure of the fuel in said pump suction chamber and operative upon being opened to connect the suction chamber to a heat exchanger to provide a heat exchange circuit for the fuel, said overflow valve being preset such that the pressure ($p_ö$) effecting its opening is greater than the maximum pressure of the injection pump in an exhaust gas test range.

2. In a fuel supply apparatus for internal combustion engines:

a fuel injection pump for supplying a regulatable fuel injection quantity drawn out of a suction chamber of said pump, said chamber having inlet and outlet conduits and being supplied with fuel under rpm dependent pressure;

an exhaust gas recirculation means controlled in accordance with fuel quantity;

and an overflow valve in said suction chamber discharge conduit;

said overflow valve comprising a two-way valve having a spring-loaded piston controlled by said pump interior pressure ($p_{pi}$) and opening each of two discharge openings in said valve selectively, wherein at a pump suction chamber pressure corresponding to an engine rpm which is within the exhaust gas test range, a discharge line is opened toward said pump inlet conduit downstream of said fuel quantity meter while at a pump interior pressure which corresponds to an rpm outside an exhaust gas test range, the discharge conduit is opened by way of said fuel supply container, for effective cooling and ventilation of said fuel injection pump at a predetermined operational range.

3. In a fuel supply apparatus as defined by claim 1 in which said heat exchanger is embodied as a cooling apparatus of a fuel supply container.

4. In a fuel supply apparatus as defined by claim 1 or 3, in which a fuel quantity meter is disposed in the inlet conduit of said fuel injection pump, said fuel quantity meter regulating the supply of fresh air and in corresponding fashion the quantity of recirculated exhaust gas to and from said engine.

5. In a fuel supply apparatus as defined by claim 1 in which said overflow valve further comprises a magnetic valve, said magnetic valve being arranged to be switched by at least one electrical pressure switch, and said at least one pressure switch controlling the magnetic valve being actuated in turn by said pump interior pressure.

6. In a fuel supply apparatus as defined by claim 5, in which said magnetic valve comprises a reversible magnetic valve and further includes means arranged to open and close said discharge conduit into said pump inlet conduit downstream of said fuel quantity meter, said means including a pressure switch controlled by an exhaust gas test range, and said magnetic valve connects said discharge conduit with a fuel supply container.

7. In a fuel supply apparatus as defined by claim 5, in which at least a second pressure switch having a response threshold located at a substantially lower rpm is provided, said second pressure switch being in series with a further switch actuated by a driving pedal in such a manner that during overrunning above the idling rpm, an additional heat exchange via a fuel supply container is possible.

8. In a fuel supply apparatus as defined by claim 6 or 7, characterized in that said magnetic valve in said discharge line is additionally switched on upon actuation of a starter means and/or by means of a thermal switch during starting and/or while the engine is still cold, in order to form said heat exchange circuit by way of said fuel supply container.

* * * * *